US007156696B1

(12) United States Patent
Montena

(10) Patent No.: US 7,156,696 B1
(45) Date of Patent: Jan. 2, 2007

(54) CONNECTOR FOR CORRUGATED COAXIAL CABLE AND METHOD

(75) Inventor: Noah P. Montena, Syracuse, NY (US)

(73) Assignee: John Mezzalingua Associates, Inc., East Syracuse, NY (US)

( * ) Notice: Subject to any disclaimer, the term of this patent is extended or adjusted under 35 U.S.C. 154(b) by 0 days.

(21) Appl. No.: 11/458,475

(22) Filed: Jul. 19, 2006

(51) Int. Cl.
*H01R 9/05* (2006.01)

(52) U.S. Cl. ..... 439/584; 439/587; 174/59

(58) Field of Classification Search ..... 439/584, 439/578, 583, 585, 587; 174/59, 655
See application file for complete search history.

(56) References Cited

U.S. PATENT DOCUMENTS

| | | | | |
|---|---|---|---|---|
| 1,348,434 | A | 8/1920 | Marshick | |
| 3,184,706 | A | 5/1965 | Atkins | 339/177 |
| 3,963,321 | A | 6/1976 | Burger et al. | 339/177 E |
| 4,128,293 | A | 12/1978 | Paoli | 339/258 R |
| 4,239,318 | A | 12/1980 | Schwartz | 339/143 R |
| 4,241,967 | A | 12/1980 | Collins | 339/59 M |
| 4,549,755 | A | 10/1985 | Kot et al. | 285/341 |
| 4,687,272 | A | 8/1987 | Spinner et al. | 439/271 |
| 4,824,401 | A | 4/1989 | Spinner | 439/584 |
| 4,979,911 | A | 12/1990 | Spencer | 439/583 |
| 5,017,157 | A | 5/1991 | Liu et al. | 439/609 |
| 5,059,747 | A | 10/1991 | Bawa et al. | 174/65 |
| 5,073,129 | A | 12/1991 | Szegda | 439/585 |
| 5,267,877 | A | 12/1993 | Scannelli et al. | 439/584 |
| 5,321,205 | A | 6/1994 | Bawa et al. | 174/65 |
| 5,354,217 | A * | 10/1994 | Gabel et al. | 439/583 |
| 5,518,420 | A | 5/1996 | Pitschi | 439/578 |
| 5,763,833 | A | 6/1998 | Bawa et al. | 174/65 |
| 5,795,188 | A * | 8/1998 | Harwath | 439/583 |
| 6,034,325 | A | 3/2000 | Nattel et al. | 174/59 |
| 6,133,532 | A | 10/2000 | Lundback et al. | 174/88 |
| 6,406,330 | B1 | 6/2002 | Bruce | 439/609 |
| 6,431,911 | B1 | 8/2002 | Pitschi | 439/583 |
| 6,590,478 | B1 | 7/2003 | Pluymers | 333/246 |
| 6,626,710 | B1 | 9/2003 | Tsai Huang | 439/825 |
| RE38,294 | E | 11/2003 | Nattel et al. | 174/59 |
| 6,783,406 | B1 | 8/2004 | Keiser et al. | 439/827 |
| 6,976,872 | B1 | 12/2005 | Wild et al. | 439/578 |
| 7,070,447 | B1 | 7/2006 | Montena | 439/578 |
| 2005/0181652 | A1 | 8/2005 | Montena et al. | 439/271 |
| 2005/0181667 | A1 | 8/2005 | Kao | 439/578 |
| 2005/0239327 | A1 * | 10/2005 | Cantz | 439/578 |

FOREIGN PATENT DOCUMENTS

EP 1 148 592 A1 10/2001

* cited by examiner

*Primary Examiner*—Gary F. Paumen
(74) *Attorney, Agent, or Firm*—Hooker & Habib, P.C.

(57) ABSTRACT

An electrical connector is mounted on a corrugated coaxial cable. An electrical connection with the outer conductor of the cable is formed by compressing an elastomer body surrounding the end of the cable and flowing the body inwardly against the cable to hold a conductive member in electrical connection with the outer conductor.

34 Claims, 7 Drawing Sheets

CONNECTOR FOR CORRUGATED COAXIAL CABLE AND METHOD

FIELD OF THE INVENTION

The invention relates to connectors for mounting on the ends of corrugated coaxial cables to establish electrical connections with the inner and outer conductors in the cables, and to methods for mounting connectors on the ends of corrugated coaxial cables.

BACKGROUND OF THE INVENTION

Corrugated coaxial cable is commonly used to carry high frequency electrical signals. In the wireless and cellular telephone industries corrugated cable is used to transmit power signals from amplifiers to antennas on the tops of towers and for radio transmitter applications. The cable is typically about ⅜" to 2" in diameter and includes a metal central conductor surrounded by a corrugated metal outer conductor. Foam insulation fills the space between the conductors. The corrugated outer conductor improves cable flexibility.

A corrugated coaxial cable may have an outer conductor that has a series of circular peaks and valleys spaced along the length of the cable. Alternatively, the outer conductor may be spiral wound with spiral peaks and valleys extending along the length of the cable.

Connectors are attached to the ends of corrugated coaxial cables to allow the cables to be connected to contact ports on electronic components such as amplifiers, antennas, splitters and the like. Conventional connectors for corrugated coaxial cable connectors include a central pin which is joined to the central conductor in the cable and an outer conductor which is clamped to both sides of an exposed peak at the end of the outer cable conductor. In order to attach the connector to the cable it is necessary to trim the ends of the conductors in the cable precisely. The outer conductor must be cut at a peak. The foam insulation under the peak end of the outer conductor must be trimmed away to expose both sides of the outer conductor for clamp engagement by the outer conductor. U.S. Pat. No. 6,133,532 discloses a conventional connector for a corrugated coaxial cable in which an electrical connection is established at a peak at the exposed end of the outer conductor after insulation has been cut away under the peak.

It is difficult and time consuming to attach a conventional coaxial connector to the end of corrugated coaxial cable. The cable must be trimmed precisely and foam insulation must be carefully cut away from under the trimmed end of the outer conductor. Specialized tools are used and practice is needed to attach the connector to a corrugated coaxial cable reliably. The physical connection between the connector and cable is not strong and may fail and break the electrical connections.

Mounting of conventional corrugated cable connectors in the field is difficult, particularly when preformed in the weather many feet above the ground on the top of a transmission tower. Mounting a connector on a conventional corrugated cable may take as many as twenty minutes.

If the connector is not mounted correctly on the end of the cable, the connection will fail. Failure may not be immediate. Delayed failure requires connector replacement, frequently at the top of the tower and greatly increases overall cost of the installation.

Accordingly, a new connector for a corrugated coaxial cable is needed that is quick and easy to install on the end of the cable, forms strong and reliable electrical and physical connections with the conductors in the coaxial cable. The connector should be easily and reliability mounted on a corrugated cable with circular or spiral wound outer conductors.

SUMMARY OF THE INVENTION

The invention is an improved coaxial cable connector for mounting on the end of a corrugated coaxial cable and establishing strong and reliable electrical connections with the central conductor and the corrugated outer conductor. The outer conductor may have circular peaks and valleys spaced along the cable or spiral wound peaks and valleys wound around the cable.

The connector is easily mounted on the cable without the necessity of trimming the outer conductor in the cable to expose a peak in the conductor. There is no need to remove insulation from under the exposed end of the outer conductor before mounting the connector on the cable.

The connector is freely inserted over the end of the cable. The central conductor extends into a contact pin at the center of the conductor. The end of the larger diameter outer conductor extends freely into a cylindrical conductive member which is surrounded by a cylindrical deformable elastomer. The elastomer is confined in a chamber in the connector between the connector body and a rearwardly extended cover.

After the cable has been inserted into the connector, the cover is forced axially toward the body to reduce the volume of the chamber, compress the elastomer, flow the elastomer radially inwardly and force the conductive member against the outer conductor to establish a reliable, large surface area electrical connection with the outer surface of the corrugated cable. The conductive member is electrically connected to the connector body so that a reliable connection is established between the outer conductor and the connector body. The contact pin engages the central conductor. The cover is frictionally held on the body so that the compressed elastomer is confined and resiliently holds the conductive member against the outer cable conductor.

Mounting of the connector on the cable forms reliable electrical connections with the inner and outer cable conductors and a strong physical connection between the connector and the cable. The physical connection extends along an appreciable length of the cable. The elastomer is deformed radially inwardly to hold the conductive member against the outer conductor at a number of corrugations in order to form a strong interlocking physical connection between the connector and cable. The connection is stronger than the physical connection formed between a corrugated coaxial cable and a conventional connector.

Other objects and features of the invention will become apparent as the description proceeds, especially when taken in conjunction with the accompanying drawings illustrating the invention, of which there are 7 sheets of drawings.

DESCRIPTION OF THE PREFERRED EMBODIMENTS

Figure 1:
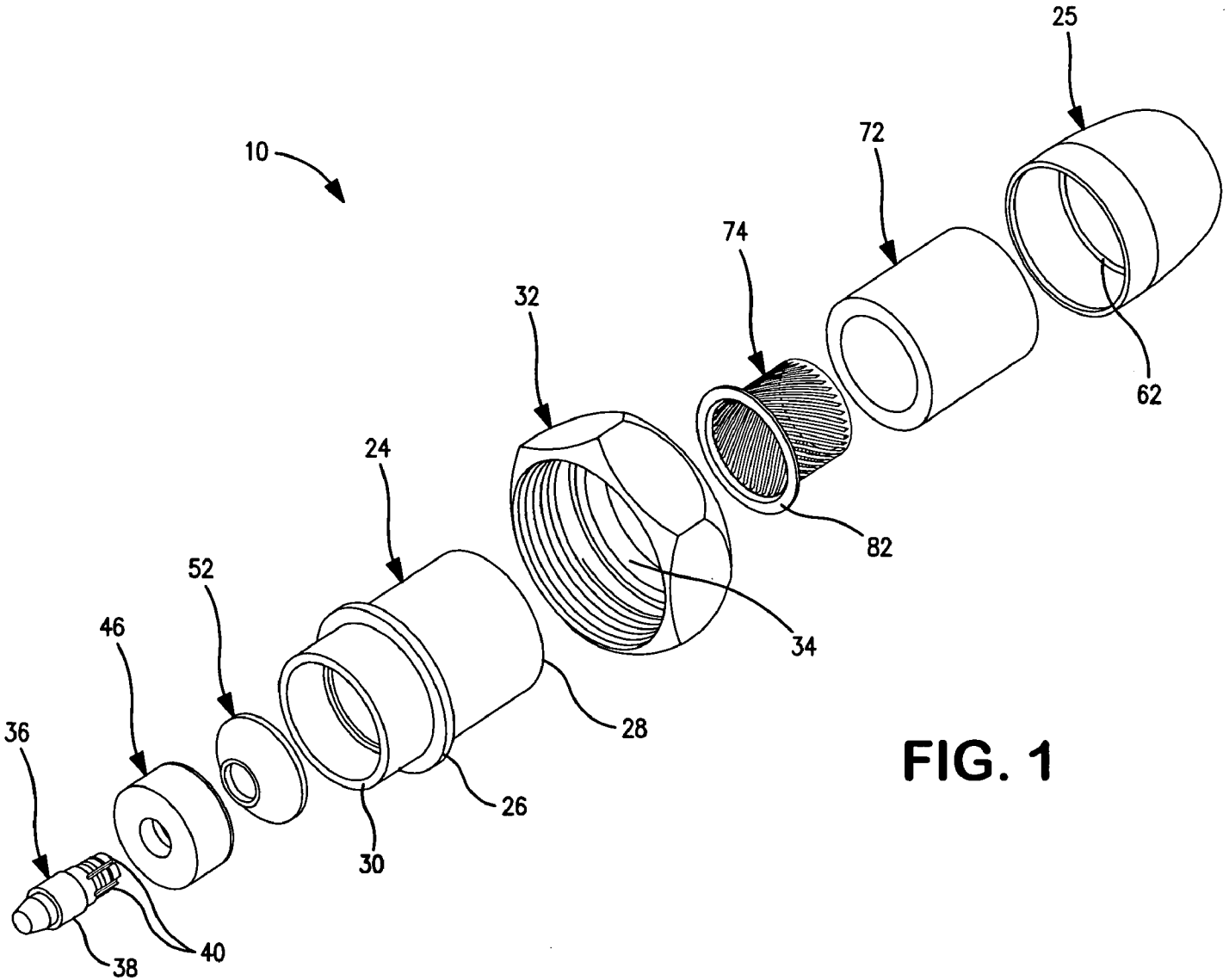
FIG. 1 is an exploded view of a connector for a corrugated coaxial cable.
Figure 2:
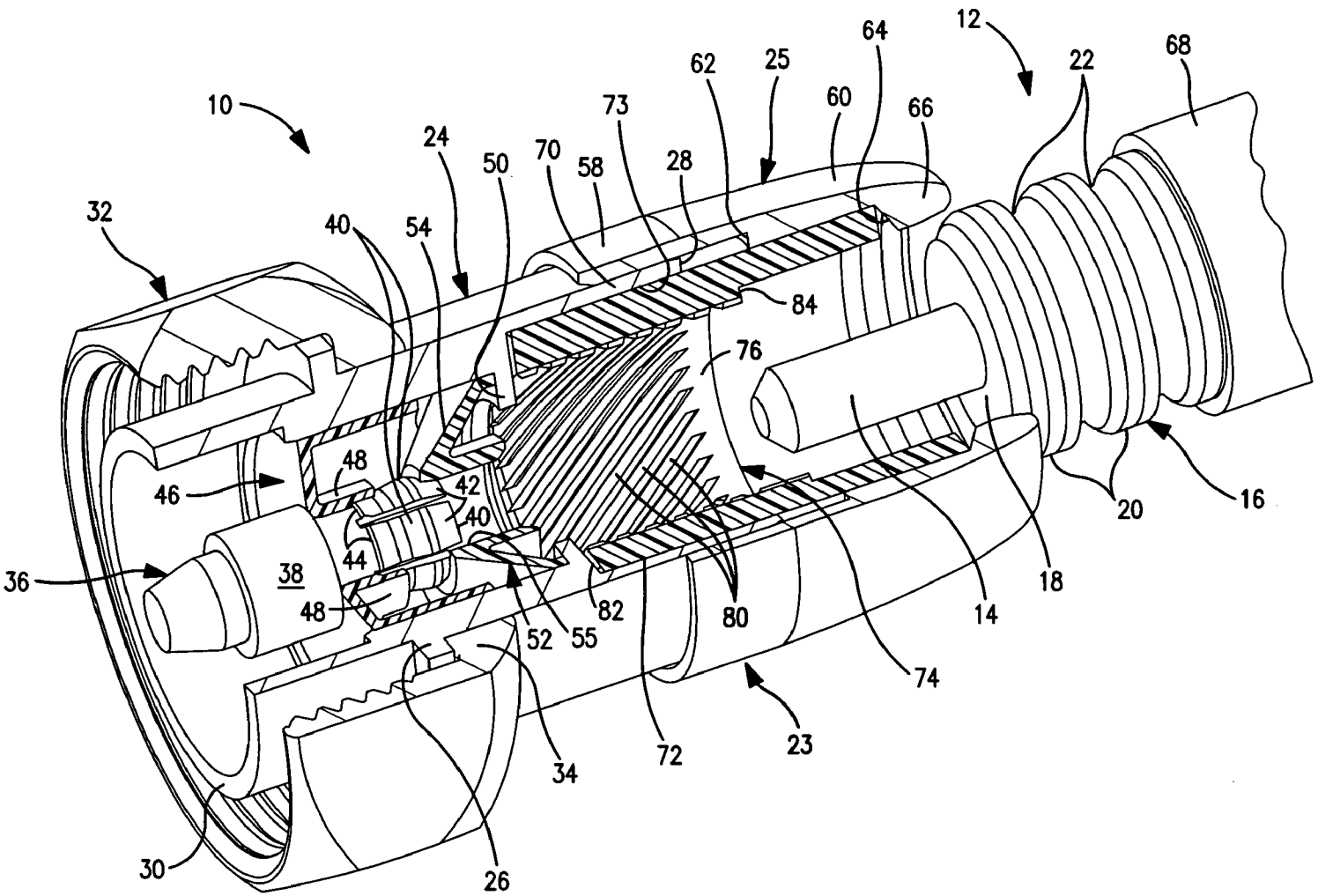
FIG. 2 is a partial sectional view illustrating the assembled connector in position to receive an end of a corrugated coaxial cable.

Coaxial cable connector 10 is mounted on the end of corrugated coaxial cable 12 and forms electrical connections with the inner metal conductor 14 and outer corrugated metal conductor 16 in the cable. The inner and outer cable conductors are separated by foamed insulation 18. The connector 10 establishes electrical connections between the cable conductors and a cable mounting port. As shown in FIG. 2, the corrugated outer conductor 16 includes a number of circular peaks 20 and valleys 22 spaced axially along the length of the cable. Alternatively, the outer conductor may be spiral wound with spiral peaks and valleys extended along the length of the cable.

Coaxial cable connector 10 includes a two-part tubular metal body 23 formed from body members 24 and 25. Member 24 has an outer flange 26 extending around the body between the cable end 28 and port end 30 of the member. Threaded coupler nut 32 is fitted over end 28 and includes a radially inward collar 34 engaging flange 26. The threads on the nut surround body port end 30.

Metal contact pin 36 establishes electrical connection with the inner conductor 14 of cable 12. Pin 36 includes central collar 38 and a number of flexible contact fingers 40 spaced around the cable end of the pin and surrounding a central opening in the cable end of the pin. The pin has a close fit in the opening. The ends 42 of fingers 40 are tapered radially inwardly. Latch shoulders 44 extend outwardly from the fingers.

Pin 36 is inserted into the central opening of cylindrical plastic alignment collar 46. Flexible fingers 48 on the inside of the collar latch onto the pin between pin collar 38 and shoulders 44. See FIG. 2. The collar 46, with pin in place, is pressed into the port end of member 24.

Body member 24 includes a radial inner flange 50 located between flange 26 and cable end 28. Plastic ring 52 is inserted into the port end 30 of member 24 prior to insertion of pin 36 and collar 46 and engages the port side of flange 50. Ring 52 includes a conical wall 54 extending radially inwardly from flange 50 defining a cylindrical wall 55 having an interior diameter slightly greater than the diameter of inner conductor 14 to permit free insertion of the inner conductor into the wall and under fingers 40. The port end of wall 55 is tapered for cam engagement with finger ends 42. The finger ends 42 extend under wall 55 on ring 52.

Body member 25 has generally cylindrical port portion 58 and cable portion 60. Portions 58 and 60 join at a circumferential step 62 facing end 28 so that portion 60 is thicker than portion 58. Inwardly facing tapered step 64 extends around cover end 66. The interior diameter of end 66 has a sliding fit on insulation 68 on cable 12. The interior diameter of portion 70 of body member 24 extending toward the cable from flange 50 is the same as the interior diameter of portion 60 between steps 62 and 64.

Elastomer member or tube 72 is fitted in interior chamber 73 of connector body 23 inside of body 23. The chamber extends between flange 50 and step 64 and around the interior of body 23. The chamber surrounds and forms the interior volume of the connector body. Cylindrical thin wall conductive member 74 is fitted inside the port end of elastomer member 72. The conductive member 74 is formed from conductive metal and includes spaced continuous cylindrical bands 76 and 78, and a plurality of spaced spiral strips 80 extending helically around the circumference of the member and joining bands 76 and 78. Integral radial flange 82 extends outwardly from band 78. The flange is located between the port end of the elastomer member 72 and flange 50.

With member 25 mounted on member 23 as in FIG. 2, elastomer member 72 extends between flange 50 and step 64 to fill chamber 73. The inner surface of member 72 includes a step 84 at the cable end of conductive member 74 having a height equal to the thickness of insulation 68 on cable 12. The interior diameter of conductive member 74 is slightly greater than the exterior diameter of cable outer conductor 16 at peaks 20 to permit free insertion of the exposed outer conductor 16 into connector 10 from the position of FIG. 2 to the position of FIG. 3.

Figure 3:
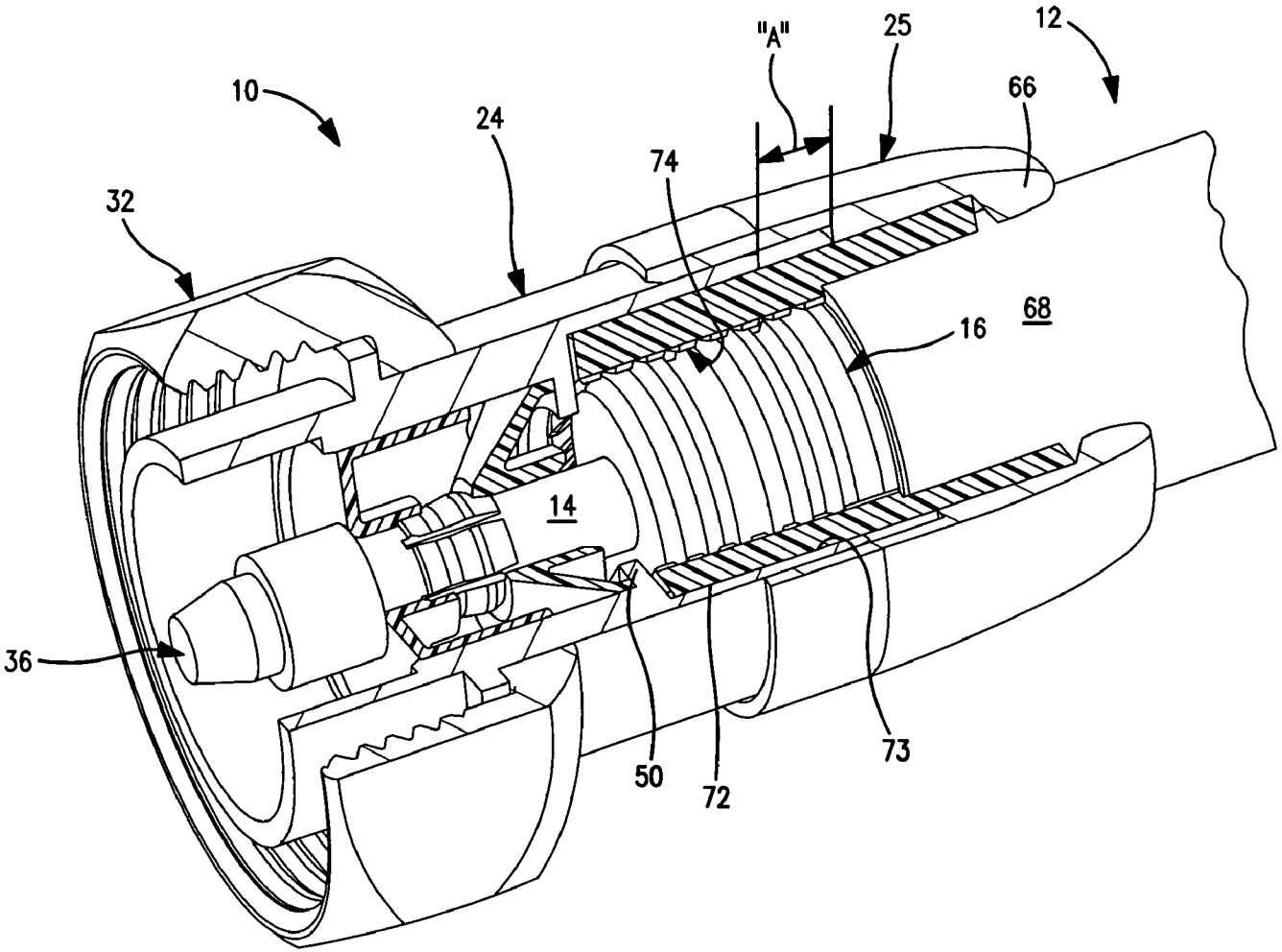
FIG. 3 is a view similar to FIG. 2 showing the cable inserted into the connector.

Insertion of the cable into the interior volume 85 of the connector to the position of FIG. 3 extends inner metal conductor 14 between pin fingers 40 and moves the lead end of the cable outer conductor 16 and insulation 18 adjacent flange 50. The outer conductor is moved into member 74 with peaks 20 engaging member 74. The end of the cable insulation 68 engages step 84. See FIG. 3.

After the cable has been inserted into the connector, a tool drives body member 25 along body member 24 a distance "A" sufficient to move step 62 against end 28. At the same time, the tool moves pin 36 and collar 46 inwardly a short distance toward the cable to wedge fingers 40 under wall 55 on ring 52, force the fingers tightly against the inner conductor 14 and form an electrical connection between the inner conductor and the pin. Frictional engagement between the inner surface of member 25 and the outer surface of body member 24 holds body 23 in the collapsed position with step 62 engaging end 28. See FIG. 4.

Movement of member 25 from the position of FIG. 2 to the position of FIG. 3 reduces the volume of chamber 73, compresses and elastically flows elastomer member 72 radially inwardly against conductive member 74 and forces strips 80 radially inwardly against the corrugated outer cable conductor 16. Each strip is held against peaks and valleys on the outer conductor of the cable. The compressed member 72 tightly holds flange 82 against body flange 50. Compressed elastomer member 72 establishes large area electrical connections between conductive member 74 and outer cable conductor 16 and body member 24. The connections extend 360 degrees around the cable.

The portion of compressed member 72 overlying the cable insulation 68 forms a weatherproof seal to prevent moisture from entering the connector along the cable insulation. The compressed elastomer also prevents moisture from entering the connector past abutting end 28 and step 62. During compression of member 72 and inward flow toward the outer cable conductor, the bands 76 and 78 and strips 80 are bent to conform to the shape of conductor 16. The compressed member 72 fills the reduced volume chamber 73 and fills the valleys in the cable.

Figure 4:
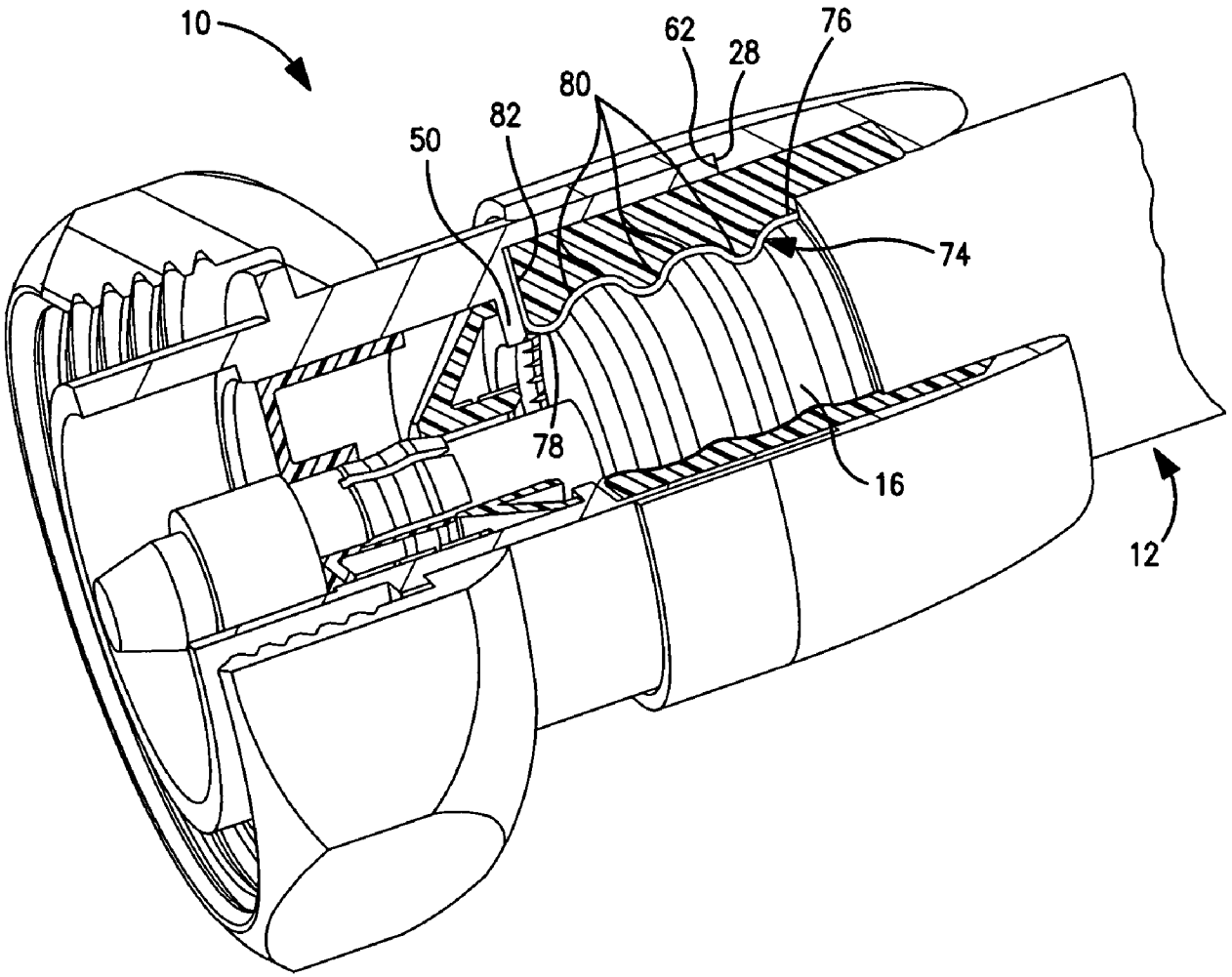
FIG. 4 is a view showing the connector fully mounted on the end of the cable.

Connector 10 is mounted on coaxial cable 12 without having to trim the end of the outer cable conductor accurately or cut away insulation under the outer cable conductor. While FIG. 4 shows a valley at the end of the outer conductor, connector 10 may be mounted on cables independently of the location of the end of the outer conductor with regard to peaks and valleys on the conductor. The large area connection improves the current carrying capacity of the connector and improves shielding. The conductive member 74 provides a 360-degree shield extending between the outer conductor 16 to body 23.

Mounting of the connector 10 on cable 12 as described also forms a strong interlocked physical connection between the connector and the cable with the elastomer flowed into valleys 22. The connection extends along an appreciable length of the cable.

Elastomer member 72 may be formed from silicone rubber or a suitable compressible elastomer having the ability of flowing elastically into the valleys in the cable and holding the conductive member 74 against the outer cable conductor 16 and flange 50.

The elastomer member may be made of a homogeneous conductive elastomer so that the entire member forms an electrical connection between the outer cable conductor 16 and body 23.

After connector 10 is mounted on cable 12 as described, the port end of the connector is attached to a conventional cable port by inserting the end into the port and rotating nut 32 to secure the connector to the port. The strong interlocked mechanical connection between the connector and the cable supports the cable extending away from the connector so that the weight of the cable does not stress the electrical connection between the connector and cable.

Figure 7:
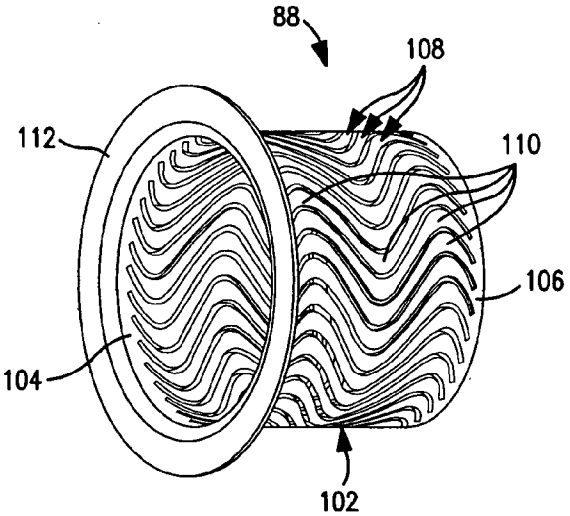
FIGS. 6 and 7 are perspective views of different embodiment conductive members.
Figure 5:
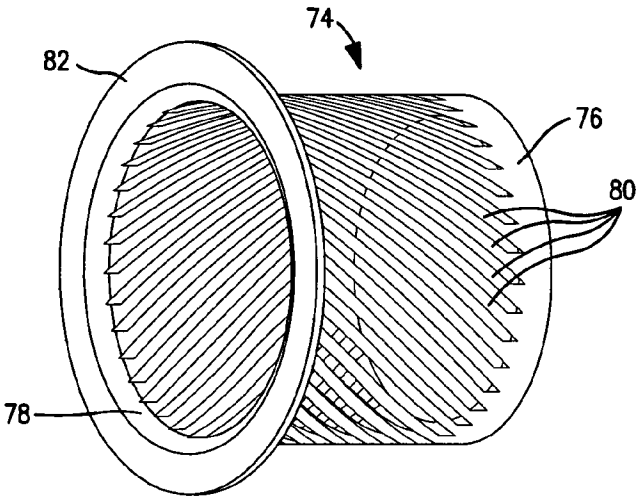
FIG. 5 is a perspective view of a conductive member for engaging the outer conductor in the corrugated cable connector.
Figure 6:
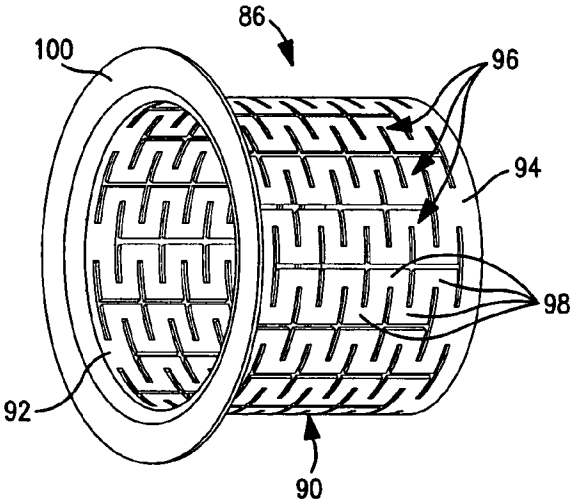

FIGS. 6 and 7 illustrate alternative conductive members 86 and 88, similar to conductive member 74. Cylindrical thin wall conductive member 86 is formed from thin conductive metal and includes a cylindrical body 90 having spaced continuous bands 92 and 94 and a number of serpentine strips 96 extending between bands 92 and 94. Serpentine strips 96 extend parallel to the axis of body 90 and include a number of slitted, sharp U-bends or reverse curves 98 spaced along the strip. The curves are formed within the thickness of body 90. As illustrated, the U-bends are closely spaced along the length of strips 98 and are separated from adjacent bends and strips by narrow slots. Radial flange 100 extends outwardly from band 92, like flange 82.

Cylindrical thin wall conductive member 88 is formed from thin conductive metal and includes a cylindrical body 102 having a pair of spaced circumferential bands 104 and 106 and a plurality of serpentine strips 108 extending between the bands. Strips 108 are generally sinusoidal in shape and include a number of smooth U-bends 110. Bends 110 are spaced along the length of the strips 108 and are separated from adjacent strips by narrow slots. Radial flange 112 extends outwardly from band 106.

Members 86 and 88 may be used in connector 10 in place of member 74. Reduction of the volume of chamber 73 flows elastomer member 72 radially inwardly to deform the strips 96 or 118 inwardly and against the corrugated outer conductor of cable 12. Compression of the body also holds flange 100 or 112 against connector member 24 so that the conductive member forms an electrical connection between the outer conductor of the cable and the connector body, as described previously.

Inward deformation of the strips of conductive members 74, 88 and 90 deforms the strips as the strips contact the surface of the corrugated outer conductor. The strips may be elongated. The U-bends in strips 96 and 108 may be opened as the strips 98 are brought into contact with the surface of the outer conductor. Bands 76, 78, 92, 94, 104 and 106 may be deformed.

Figure 8:
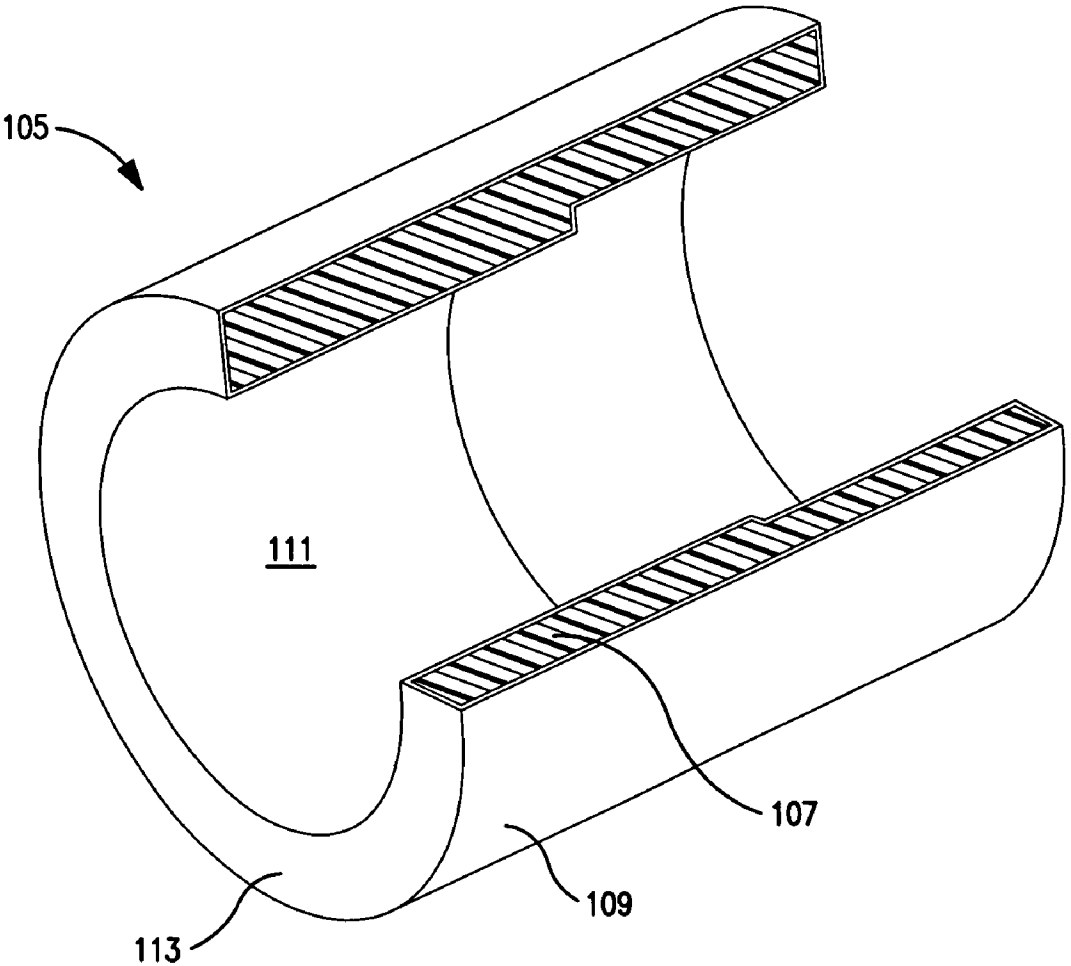
FIG. 8 is a partial sectional view of an elastomer member with a conductive surface.

FIG. 8 illustrates a tubular conductive elastomer member 105 which may be used in coaxial cable connector 10 in place of elastomer member 72 and conductive member 74. Member 105 has an elastomer body 107 like the body of member 72 with an integral thin conductive layer or skin 109 on the outer surface of body 107. When the connector using member 105 is collapsed as shown in FIG. 4, the inner portion 111 of layer 109 is forced against the peaks and valleys of the outer cable conductor to form an electrical connection with the outer conductor. At the same time, end face 113 of the conductive layer is forced against flange 50 to form an electrical connection with body member 24. The conductive layer 109 forms a 360 degree continuous electrical connection between the outer cable conductor and the connector body.

The outer conductive layer 109 may be formed from a rubber with conductive material diffused throughout the rubber. The conductive material may be carbon filaments or metal filaments or carbon nano tubes which contact each other. Alternatively, the conductive layer may be a thin metal foil bonded to the elastomer.

Figure 9:
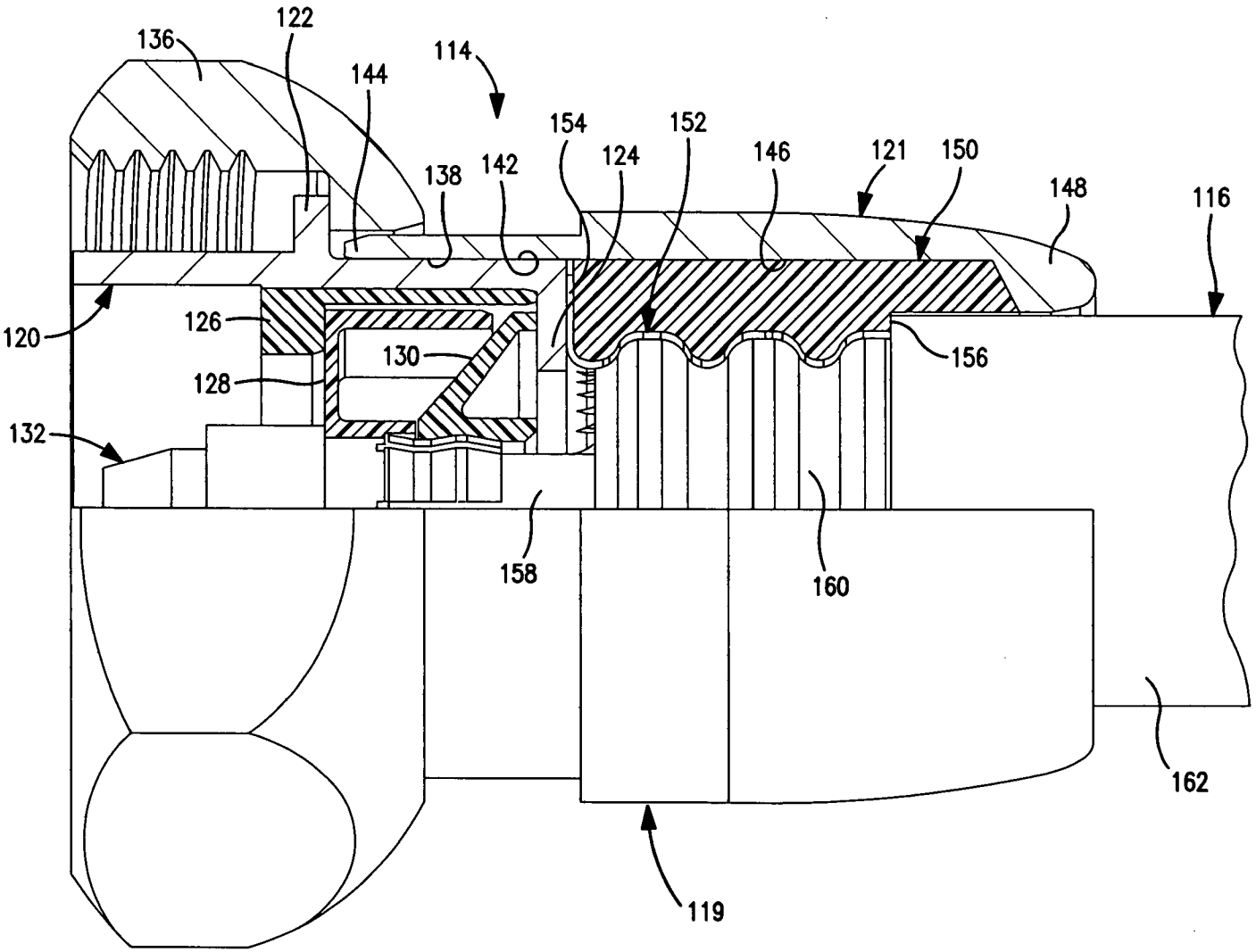
FIG. 9 is a view of a second embodiment connector.

Second embodiment connector 114 shown in FIG. 9 forms electrical connections with corrugated coaxial cable 116. The connector 114 is similar to connector 10. The cable may be identical to cable 12 or, alternatively, may have spiral wound outer corrugations.

Connector 114 has a two-part tubular metal body 119 formed from tubular body members 120 and 121. Member 120 has an outwardly extending flange 122 located between the port end of the member and radially inwardly extending flange 124 at the cable end of the member. Bushing 126 is seated in the interior of the member and holds collar 128 and ring 130 in place in the body with the ring abutting flange 124. Collar 128 and ring 130 are similar to previously described collar 46 and ring 52. The collar and ring hold contact pin 132 in body 120. Pin 132 is identical to pin 36. Member 121 is mounted on the exterior surface of member 120 between flanges 122 and 124. Member 121 is tubular and includes a cylindrical inner surface 138 having a friction fit on the outer surface 142 of member 120. Nut 136, like nut 30 is mounted on member 120 and engages flange 122.

Prior to mounting the cable on connector 114, the connector is in a cable-receiving position with member 121 shifted to the right of the position shown in FIG. 9. The port end 144 of the member is on member 120 a distance away from flange 122. Unstressed elastomer tube or member 150, like member 72, is fitted in chamber 146 extending between flange 124 and end 148. A thin wall cylindrical conductive member 152, which may be identical to one of the previously described members 74, 86 or 88, is positioned in the port end of the elastomer body 150. Member 152 includes a radial flange 154 located between the port end of body 150 and flange 124. The body 150 includes a step 156 like step 84.

With connector 114 in the cable-receiving position, cable 116 is inserted into member 121 with inner conductor 158 extending into pin 132 and the corrugated outer conductor 160 in the cylindrical portion of conductive member 152. The end of the insulation 162 on cable 116 engages step 156.

After insertion of the cable, a tool is used to drive the member 121 toward member 120 to the position shown in FIG. 8. The volume of chamber 146 is reduced so that the elastomer body 150 is compressed and flows radially inwardly to deform the cylindrical portion of conductive member 152 against the outer conductor 160 and establish an electrical connection therewith. Compression of the elastomer member also holds the conductive member against flange 154 to form electrical connection between the flange and body 120. The tool drives pin 132 toward cable 116 to seat the fingers on the cable end of the pin under ring 130 to form an electrical connection between the conductor and pin. Frictional engagement between members 120 and 121 holds the body in the position shown in FIG. 9 to maintain the interlocked electrical and physical connection between the connector and cable.

While I have illustrated and described preferred embodiments of my invention, it is understood that this is capable of modification, and I therefore do not wish to be limited to the precise details set forth, but desire to avail myself of such changes and alterations as fall within the purview of the following claims.

I claim:

1. A connector for mounting on the end of a coaxial cable having a corrugated outer conductor, the connector comprising: a conductive body having an interior wall surrounding a cable-receiving cavity, the cavity opening at one end of the body; an elastomer member in the cavity; a conductive member in the cavity positioned between the elastomer member and an outer conductor of a corrugated coaxial cable in the cavity and between the elastomer member and the body, said elastomer member in direct contact with the conductive member, and said conductive member in direct contact with both the corrugated outer conductor of the coaxial cable and in direct contact with the body, wherein compression of the elastomer member holds the conductive member against both the corrugated outer conductor of the coaxial cable and the body to form an electrical connection therebetween.

2. The connector as in claim 1 including a chamber in the interior wall of the body, said elastomer member located in said chamber.

3. The connector as in claim 2 wherein the chamber extends around the cavity and the elastomer member is tubular.

4. The connector as in claim 3 wherein said body includes two relatively moveable body members defining opposed walls of said chamber, wherein movement of said body members toward each other compresses the elastomer member.

5. The connector as in claim 4 including a friction connection between said body members.

6. The connector as in claim 3 wherein the conductive member includes a circumferential flange contacting said body.

7. The connector as in claim 1 wherein when said elastomer member is compressed the elastomer member and said conductive member conform to peaks and valleys on the outer conductor.

8. The connector as in claim 1 wherein said elastomer member is tubular and the conductive member includes a cylindrical portion located inside said elastomer member.

9. The connector as in claim 8 wherein said conductive member includes a portion extending outside of the tubular elastomer member, said portion contacting the body.

10. The connector as in claim 9 wherein said portion of the conductive member comprises a circumferential flange.

11. The connector as in claim 1 wherein said conductive member includes a metal strip located between the elastomer member and the outer conductor of the coaxial cable and conforming to the shape of the outer conductor.

12. The connector as in claim 11 wherein the conductive member includes a plurality of stripe extending helically around the cable.

13. The connector as in claim 12 wherein each strip includes a bend.

14. The connector as in claim 1 wherein the elastomer member and the conductive member are integral.

15. The connector as in claim 1 wherein the elastomer member and the conductive member are non-integral.

16. The connector as in claim 1 wherein the conductive member is formed from metal.

17. The connector as in claim 1 wherein the conductive member is formed from non-metal.

18. The connector as in claim 1 including a contact pin and an electrical connection between the contact pin and the central conductor of the cable.

19. The combination of a connector on a corrugated coaxial cable, the combination comprising a connector having a tubular body with an interior wall surrounding a cable-receiving opening, a compressed elastomer member located in the opening; a corrugated coaxial cable having an outer conductor with peaks and valleys, said cable located in the opening; and a conductive member in the opening located both between the elastomer member and the outer conductor of the cable and between the elastomer member and the body, said conductive member in direct contact with peaks and valleys of the outer conductor of the corrugated coaxial cable and in direct contact with the body, and said compressed elastomer member in direct contact with the conductive member, so that the compressed elastomer member holds the conductive member against both the peaks and valleys of the outer conductor of the cable and the connector body to form an electrical connection therebetween.

20. The combination as in claim 19 wherein the elastomer member and the conductive member are integral.

21. The combination as in claim 19 wherein the elastomer member and the conductive member are non-integral.

22. The combination as in claim 19 including a chamber in the opening, the elastomer member located in the chamber.

23. The combination as in claim 22 wherein the chamber extends around the opening; and the elastomer member is tubular and surrounds the end of the cable.

24. The combination as in claim 19 wherein the conductive member is formed from metal.

25. The combination as in claim 19 wherein the conductive member is formed from non-metal.

26. The combination as in claim 25 wherein the conductive member includes carbon.

27. The combination as in claim 19 wherein the conductive member includes a number of elongate conductive members.

28. The combination as in claim 19 wherein said conductive members include nano tubes.

29. The combination as in claim 19 including a contact pin and an electrical connection between the contact pin and the central conductor of the cable.

30. A method of forming an electrical connection between a connector body and the corrugated outer conductor of a coaxial cable, the method comprising the steps of:

A) providing a connector having a body, a cable-receiving cavity in the body opening at one surface of the body, an elastomer member in the cavity and a conductive member in the cavity, the elastomer member in direct contact with the conductive member, the conductive member in direct contact with the body and positioned for direct contact with the corrugated outer conductor of a coaxial cable positioned in the cavity;

B) providing a coaxial cable having an exposed corrugated outer conductor;

C) positioning the coaxial cable in the cavity; and

D) forming an electrical connection between the corrugated outer conductor of the coaxial cable and the body by compressing the elastomer member against the conductive member to hold the conductive member against both the corrugated outer conductor of the cable and the body.

31. The method of claim 30 wherein the elastomer conductive member includes a number of metal strips including the step of:

E) bending the strips against the corrugated outer surface of the coaxial cable.

32. The method of claim 30 wherein the cable includes an inner conductor including the step of:

F) forming a 360 degree shield surrounding the inner conductor and extending between the outer conductor and the body.

33. The method of claim 30 comprising the step of:

G) positioning the elastomer member in a chamber in the cavity and reducing the volume of the chamber to compress the elastomer member.

34. The method of claim 33 wherein the body includes two relative removable members defining opposed surfaces of the chamber, including the step of:

H) reducing the volume of the chamber by moving the members toward each other, and forming a connection between the members.

* * * * *

UNITED STATES PATENT AND TRADEMARK OFFICE

CERTIFICATE OF CORRECTION

PATENT NO. : 7,156,696 B1
APPLICATION NO. : 11/458475
DATED : January 2, 2007
INVENTOR(S) : Noah P. Montena It is certified that error appears in the above-identified patent and that said Letters Patent is hereby corrected as shown below:

In the Claims:

Column 9, line 12, delete “elastomer”.

Signed and Sealed this

Twentieth Day of March, 2007

JON W. DUDAS
*Director of the United States Patent and Trademark Office*